US008490536B2

(12) United States Patent
Butler

(10) Patent No.: US 8,490,536 B2
(45) Date of Patent: Jul. 23, 2013

(54) ACCESSORY FOR WEAPON MUZZLE

(75) Inventor: Troy C Butler, Wilder, ID (US)

(73) Assignee: Fortune Forge LLC, Wilder, ID (US)

( * ) Notice: Subject to any disclaimer, the term of this patent is extended or adjusted under 35 U.S.C. 154(b) by 120 days.

(21) Appl. No.: 13/160,991

(22) Filed: Jun. 15, 2011

(65) Prior Publication Data

US 2012/0317853 A1 Dec. 20, 2012

(51) Int. Cl.
*F41A 21/28* (2006.01)

(52) U.S. Cl.
USPC ..... 89/14.3

(58) Field of Classification Search
USPC .... 89/14.3, 14.4, 29, 30; 42/54, 55; 124/44.7, 124/64, 65
See application file for complete search history.

(56) References Cited

U.S. PATENT DOCUMENTS

| | | | | |
|---|---|---|---|---|
| 2,725,868 | A * | 12/1955 | Foster | 124/65 |
| 2,855,712 | A * | 10/1958 | Diletto | 403/24 |
| 4,157,703 | A | 6/1979 | Brown et al. | |
| D281,895 | S | 12/1985 | McLain | |
| 5,205,773 | A * | 4/1993 | Koepcke et al. | 446/183 |
| 5,718,572 | A | 2/1998 | Hitzel | |
| 7,140,140 | B2 | 11/2006 | Yoshitaka | |
| D577,409 | S | 9/2008 | Brittingham | |
| D605,724 | S | 12/2009 | Heath | |
| 2004/0213704 | A1 | 10/2004 | Reed | |

OTHER PUBLICATIONS

Maryland Shooters website, comments string (with reference to ornaments that screw into the choke threads), Dec. 5, 2010.
http://store.troyind.com, Medieval Flash Suppressor, Feb. 23, 2011.
http://www.cheaperthandirt.com, AK-47 Muzzle Brake, May 4, 2011.

* cited by examiner

*Primary Examiner* — Stephen M Johnson
(74) *Attorney, Agent, or Firm* — Pedersen and Company, PLLC; Ken J. Pedersen; Barbara S. Pedersen

(57) ABSTRACT

A weapon accessory in the likeness of a human, animal, mythical, or other creature, or a part of the creature, has a longitudinal passageway adapted to allow a projectile to exit the muzzle through the invented device. The projectile passageway opens through a mouth, eye, nose/nostril, or ear structure. Additional apertures selected from these structures, other than the one selected for the projectile exit, are in fluid communication with the projectile passageway for directing gasses from the weapon discharge in desired directions, in order to serve as a muzzle brake. The additional apertures preferably extend generally upward at an angle to said projectile passageway, including straight upward, upward and forward, or upward and rearward, and may also extend to a left or right side.

14 Claims, 6 Drawing Sheets

ACCESSORY FOR WEAPON MUZZLE

BACKGROUND OF THE INVENTION

1. Field of the Invention

The invention is a device that attaches to the end of a gun muzzle, and may be used for directing gasses exiting the muzzle in desired directions, for example, as a muzzle brake. The device has features comprising at least a part of a human, animal, or creature's face or head. While these features have some ornamental quality, one or more of the features also perform utilitarian functions. The mouth, eyes, ears, nose and/or other apertures through the creature's face/head may serve as direction-directors for the gasses. One of the mouth, eyes, ears, nose or other aperture serves as the projectile-exit aperture.

2. Related Art

Conventional muzzle brakes are typically generally tubular cylinders, with several parallel slots through a portion of the generally cylinder wall. The gasses flow through the wall of the brake in upward direction and, therefore, apply a downward force to the end of the muzzle. The downward force tends to control swinging of the muzzle in an upward direction upon discharge of the weapon. Optionally, conventional devices may include baffles inside the device to suppress the flash and/or noise of the discharge.

SUMMARY OF THE INVENTION

The invented device connects to a muzzle end and has a longitudinal passageway adapted to allow a projectile to exit the muzzle through the invented device. At the outer (distal) end of the longitudinal passageway is an opening having the form of a mouth, eye, nose/nostril, or ear of a human, animal, mythical, or other creature. The invented device has at least one, and preferably several, additional apertures in fluid communication with the projectile passageway for directing gasses from the weapon discharge in desired directions. Said additional apertures are preferably circular, oval, or otherwise-shaped conduit extending from the projectile passageway to open at an upper, outer surface of the device. Said additional apertures preferably extend in a direction that has an upward component and a component that is either forward or rearward. In other words, said additional apertures may comprise surfaces/conduits that are slanted forward, perpendicular, or slanted slightly rearward, relative to the longitudinal axis of the bore of the muzzle/barrel and, hence, the longitudinal axis of the projectile passageway. We define the longitudinal axis of the device and the projectile passageway as being the same. Therefore, one may describe the additional apertures as comprising surfaces/conduits that extend at angles ranging from acute angles to somewhat obtuse angles relative to the forward longitudinal axis. Preferably, the additional apertures comprise surfaces/conduits that extend in a range from forward at an angle of 5 degrees, up to 90 degrees (perpendicular). Also, the additional apertures may comprise surfaces/conduits that extend in a range from 90 degrees from the longitudinal axis to 45 degrees rearward. In other words, the preferred surfaces/conduits may extend 5-135 degrees from the longitudinal axis.

Said additional apertures preferably represent as an eye(s), nostril(s)/nose, ear(s), and/or mouth of said human, animal, mythical, or other creature. Thus, the projectile passageway opening and other apertures of the device are not simple longitudinal slots in the upper surface of the device, but tend to have natural shapes and locations according to features of a face/head.

The mouth, eyes, nostril(s)/nose, and ear(s) of a face/head are naturally in an arrangement that is conducive to the desired functionality of the preferred muzzle brake. For example, a mouth-throat passageway may be used as the projectile path and exit, with the eyes, nose, and/or ears being above the mouth-throat. Therefore, the eyes, nose, and ears are above the projectile passageway and, when opened to the projectile passageway on an inner (lower) end and open to the air above the muzzle brake at an outer (upward) end, they provide the desired muzzle-brake functionality, that is, providing a downward force on the muzzle end. For example, opening up both eyes, both nostrils, and/or both ears directs gasses upward. Also, depending on the chosen shape and radial orientation (perpendicular, or forward, or rearward slanting) of the surfaces/conduits of the mouth, eyes, nostril(s)/nose and ear(s), additional forces on the muzzle (in addition to a downward force) may be created. For example, if said surfaces/conduits are perpendicular to the longitudinal axis, forces from impingement of gases on the perpendicular surfaces are expected to serve as anti-recoil forces, by forcing the muzzle forward (in addition to the upward "jet" of gasses serving as anti-muzzle-climb forces). Or, if said surfaces/conduits are slightly rearward-slanted, the rearward component of the "jet" forces may also serve as an anti-recoil force as well as an anti-muzzle-climb force. Thus, the mouth, eyes, nostril(s)/nose and ear(s) additional apertures provide the desired gas-direction without additional openings such as conventional muzzle break slots. If the nose is used as the projectile path and exit, the eyes and/or ears are still above the projectile passageway, and, when opened to the passageway on an inner end and open to the air above the muzzle brake, provide the desired muzzle-brake functionality. The surface of the device surrounding one or more of the additional apertures may have contouring, recesses or protrusions, lines, or decoration that enhances the natural appearance of the apertures, for example, scales, eyelids, bone structure, feathers, etc. The gas-directing apertures may be sized, and may have surface curvature, for fine-tuning the forces applied to the muzzle by the gasses, and/or for controlling noise directed back to the shooter. This sizing and curvature may be determined by one of skill in the art without undue experimentation.

The preferred muzzle brake does not include significant baffling inside the device, but baffles, and/or expansion chambers, or other structure may be added as an option. The projectile passageway may be a generally cylindrical or tubular surface, or other surface forming a hollow space extending generally from one end of the device to the other, from which the gas-directing passageways branch off in a generally upward direction. The projectile passageway may be smooth, or may have some texture, such as ledges or spirals, for example.

While it is preferred that the gas-directing apertures are selected from only (1) an aperture on the longitudinal axis (also the projectile passageway) and/or (2) have a significant upward direction component (rather than downward), a third type of aperture may less preferably also be provided, which third type has a substantial downward component. Gas jets exiting the third-type, downward apertures may tend to counteract the upwardly-directed jet action, and hence, may counteract the desired anti-muzzle-climb forces, the force from downward-directed apertures may be beneficial for balancing forces around the muzzle circumference and/or further enhancing anti-recoil forces.

DETAILED DESCRIPTION OF THE PREFERRED EMBODIMENTS

Referring to the Figures, there are shown several, but not the only, embodiments of the invented weapon muzzle accessory. The accessory is connected to the distal end of the muzzle, by various mean, for example, a threaded connection (FIGS. 1-10, 12-15 or a pinned connection (FIG. 11) or other means, including conventional connections for muzzle brakes or flash suppressors or silencers. The main functions of the invented device comprise exiting of the projectile via a passageway through the device, and exiting and directing of gasses through the projectile passageway and additional apertures. In addition, the outer form of the device, and the passageway and additional apertures, form the likeness of a creature, such as a human or human head, an animal or animal head, a mythical creature or creature head, and/or portions of said creatures/heads, etc. This way, while the device performs desired functions, the appearance is also interesting or amusing, and the appearance may also serve to call attention to, and identify, a particular weapon in a group of similar weapons. The device may be sold already attached or integral with the weapon. More preferably, the device may be sold as a separate, disconnected accessory, so that the user may select his/her own preferred device and/or switch devices as the hunting or shooting environment changes or as his preferences change.

Figure 1:
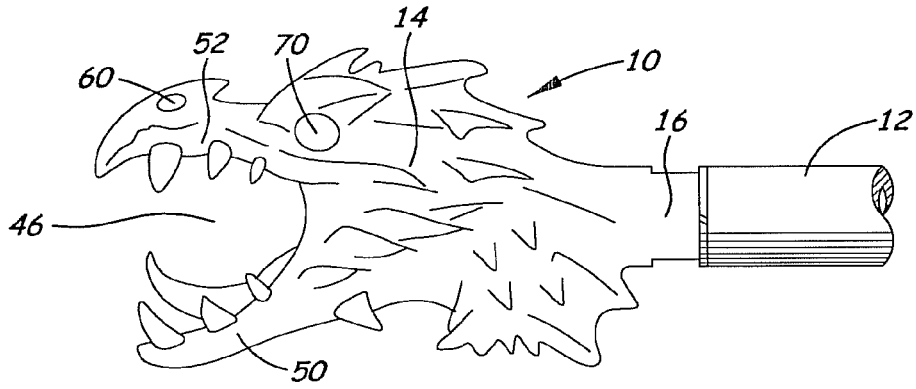
FIG. 1 is a side view of one embodiment of the invention, connected to a muzzle barrel by a threaded connection, wherein the device is formed to look like a dragon head and wherein the mouth is the projectile passageway and the eyes are gas-directing passages.
Figure 2A:
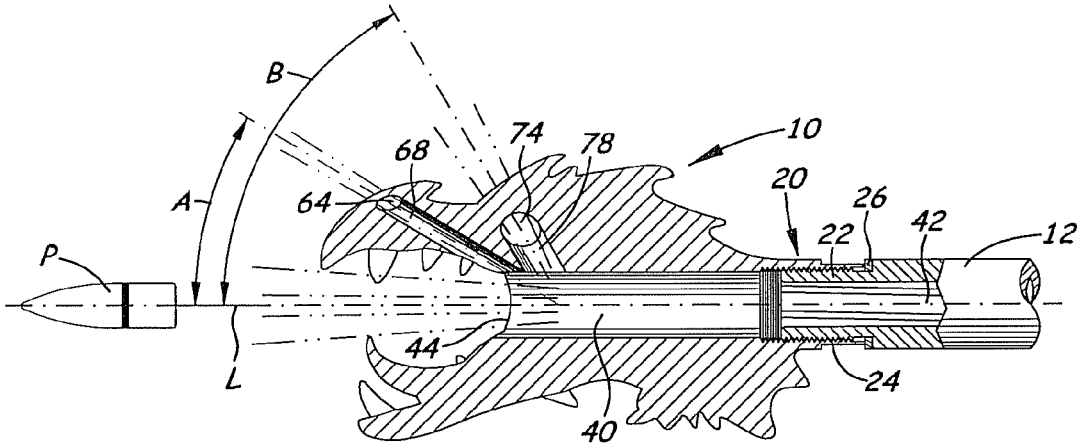
FIG. 2A is a vertical, longitudinal cross-sectional view of the device of FIG. 1, showing the projectile exiting the mouth and gasses leaving an eye.
Figure 2B:
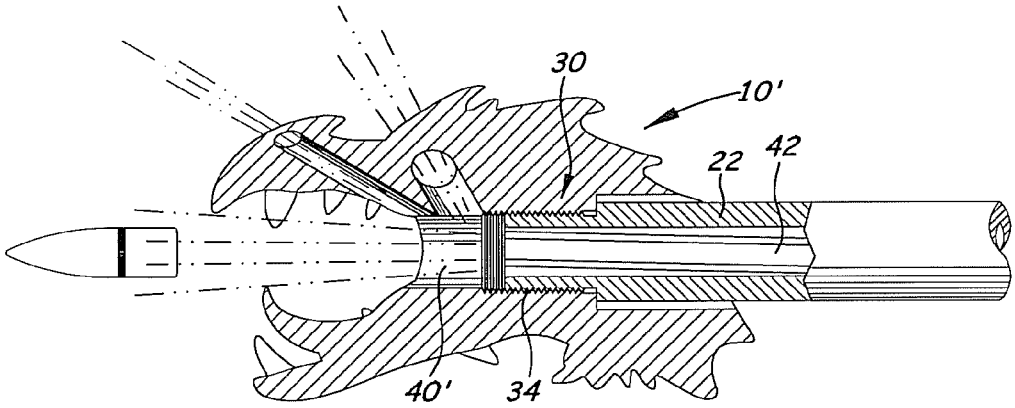
FIG. 2B is a vertical, longitudinal cross-sectional view of a device similar to that in FIGS. 1 and 2A, except that the connection includes the muzzle extending into the head of the dragon, and the threaded connection being generally centrally-located inside the muzzle brake.
Figure 3:
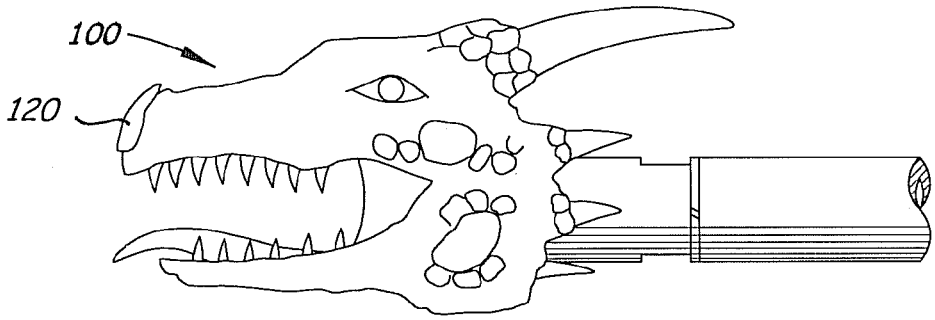
FIG. 3 is an alternative embodiment, in the form of an alternative dragon, wherein the mouth is the projectile passageway, and the eyes and/or nose may be gas-directing passages.
Figure 4:
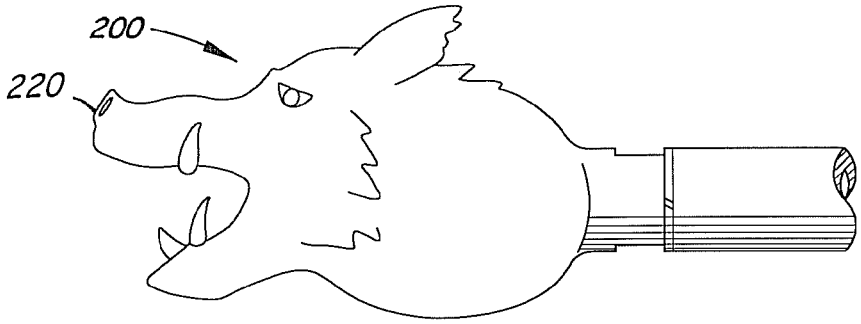
FIG. 4 is an alternative embodiment, taking the form of a boar, wherein the mouth is the projectile passageway, and the eyes, and/or nose, and/or ears may be gas-directing passages.

FIGS. 1-2B show to best advantage how an embodiment of the device, in this case a dragon-head device 10, connects to a muzzle distal end 12 and has an interesting and unique appearance. One may see that this device 10 represents that entire head 14 of a dragon and a portion of the neck 16 of the dragon, wherein the neck 16 is connected to the muzzle at connection 20. This connection 20 is a threaded connection between the threaded male muzzle end 22 and the female threaded interior surface 24 of the neck. This connection 20 connects the bore 42 of the muzzle with a passageway 40 through the device that extends along the length of the device 10. A locking washer 26 or other lock and/or gasket device may be provided as a part of the connection 20.

An alternative threaded connection 30 is shown in cross-section in FIG. 2B, wherein the threaded male muzzle end 22 remains the same as in connection 20, but the female threaded interior surface 34 is recessed deeper into the device 10'. This provides a projectile passageway 40' that is shorter than in device 10, because the connection 30 is generally in the middle of the device 10' rather than in the proximal portion (neck) of the device.

Referring again to FIGS. 1 and 2A, device 10 comprises passageway 40 that is coaxial with the hollow interior bore 42 of the muzzle, wherein the passageway 40 has distal opening 44 ("the mouth opening") inside the mouth 46 of the dragon. The opening 44 may be recessed a significant distance inside the mouth/device, for example, rearward from the lips, front teeth, snout, etc. that form the distal-most extremity of the device. The projectile P exits the passageway 40 between the midway point and the distal-most extremity of the device. While this placement of the opening 44 is not necessarily required in all embodiments, it will be effective in many embodiments because of the desire to have jaws and/or teeth that open and protrude forward of the opening. Preferably, therefore, the device comprises a lower jaw 50 and an upper jaw 52, which are connected at or near the opening 44. Portions or the lower jaw 50 and upper jaw 52, however, separate from each other as they protrude forward, in that the forward portion of the device has open right and left sides 54, 56 (see FIGS. 5A and 8), which represent the open sides of the mouth.

The lower and upper jaws 50, 52 may be described as spaced-apart lower and upper plates that are generally, but not necessarily exactly, parallel to the longitudinal axis L of the device. Also, because the muzzle and longitudinal axis L of the device are typically generally horizontal when fired, the plates may also be described as generally horizontal during many instances of use. The plates preferably are not attached/connected by vertical structure/plates at the right and left edges of said lower and upper plates, and so the mouth may be described as open at its right and left sides.

Additional apertures are provided for gas-directing, that is, to convey gasses from the discharge of the weapon out of the device 10, 10' in desired directions. Said desired directions are typically generally upward, in that the conduit or surfaces forming the additional apertures are oriented in a direction having a significant upward component (wherein the muzzle longitudinal axis if held horizontally). These additional apertures, in devices 10, 10', are nostrils 60, 64 and eyes 70 and 74. Each aperture typically comprises, or may be described as being defined by, an elongated conduit 68 and 78. Each conduit 68, 78 has an inner end at, and in fluid communication with, the passageway 40, and an outer end at the outer surface of the device 10. This way, each conduit 68, 78 receives gas, from the explosion of the gun-powder or other propellant, from the passageway 40 and delivers it out of the device 10 to the atmosphere. It should be noted that, while many of the weapons on which the invented device will be installed will use gun-powder, other will be weapons/guns/markers using other propellants, even air or CO2 (Air-Soft™ guns, or paintball markers, for example).

In the embodiment portrayed in FIG. 2A, the angle A, B, of the conduit to the longitudinal axis of the muzzle and the longitudinal axis of the device 10 (and typically to horizontal) is an acute angle (measured from the forward end of the axis, as shown in FIG. 2A). Thus, the conduits of the additional apertures in FIG. 2A extend forward and upward, and the force of the gas tends to force the muzzle slightly downward. Thus, the position of these additional apertures tends to make the device an anti-muzzle-climb muzzle brake, by helping prevent swinging of the muzzle end upward upon firing of the weapon. Because of the significant forward direction component of these two conduits in FIG. 2A, these additional apertures may not provide significant anti-recoil muzzle brake force. Additional apertures according to embodiments of the invention having conduit/surfaces at or near 90 degrees, or slightly rearward, will tend to provide more anti-recoil muzzle brake force, due to the impingement/impact of gasses on the more radial surfaces and/or due to a rearward "jet" of gasses. By "slightly rearward" is meant a direction of up to and including 45 degrees rearward from perpendicular, in other words, an obtuse angle of up to and including 135 degrees from the forward longitudinal axis. See, for example, the embodiments in FIGS. 14 and 15 for angles H and J, which are 90 degrees, and angles I and K, which are about obtuse angles of 120-130 degrees. It should be noted that fluid dynamics (fluid flow considerations) may affect the sizes of the apertures/conduits, but those of skill in the art may size the apertures/conduits appropriately for the muzzle brake effects that are desired. The fluid dynamics of the system may also be controlled by having one of more of the nose, eye and/or ear features of the face/head be closed or solid, that is, without an aperture, conduit, or any hole.

Figure 14:
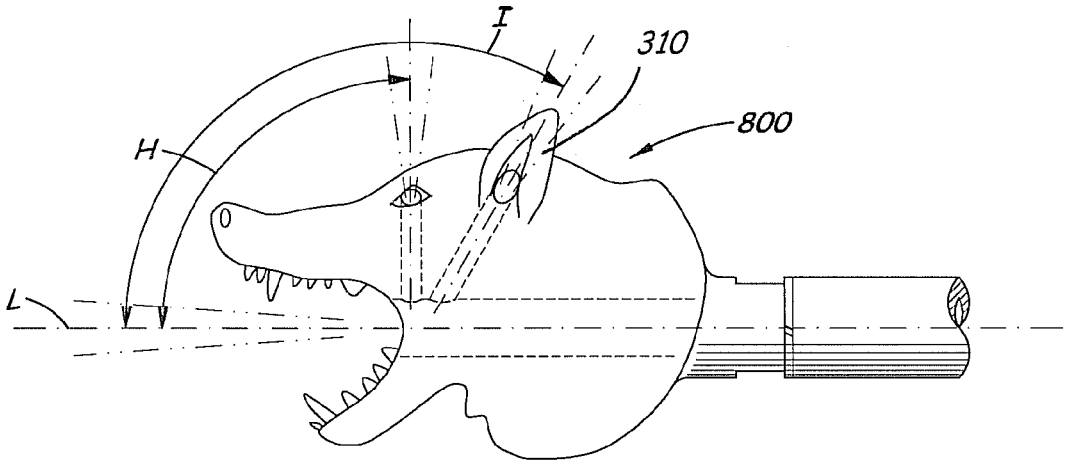
FIG. 14 is a side view of the wolf/wide dog embodiment of FIGS. 5A and B, but wherein the eye and ear aperture conduits are perpendicular (90 degrees, radially), and rearwardly angled (at an obtuse angle of approximately 120 degrees), respectively. Both of these conduits branch off from the projectile passageway at locations rearward from the mouth opening.
Figure 15:
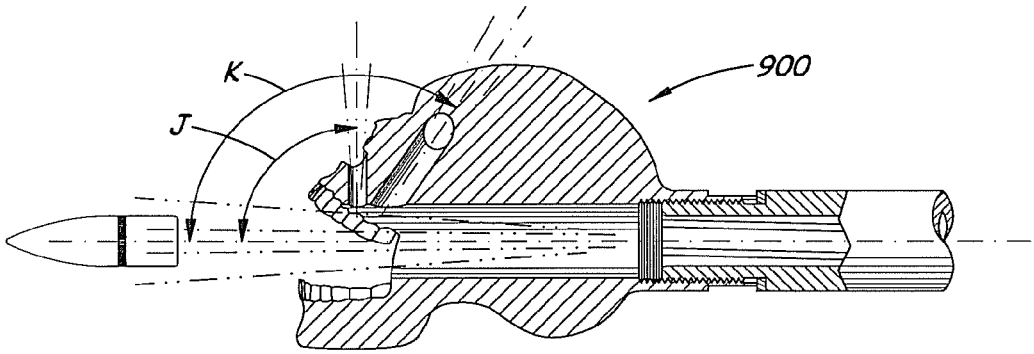
FIG. 15 is a cross-sectional view of the skull embodiment of FIGS. 10 and 13, but wherein the nose hole and eye conduit branch off from the projectile passageway at locations in the mouth, rather than rearward from the mouth opening. The nose hole conduit extends perpendicularly (90 degrees, radially) from the longitudinal axis, and the eye conduit extends rearward at about 40 degrees from the nose hole conduit, or an obtuse angle of 130 degrees from the longitudinal axis.

In FIG. 2A, angle A is portrayed as an example at approximately 30 degrees from the longitudinal axis L, and angle B is portrayed as an example at approximately 80 degrees from the longitudinal axis L. However, many of the conduits of the additional apertures will branch off of the projectile passageway at locations more distal/forward in the device. This will allow the conduit angles to be close to or exactly 90 degrees, or slightly rearward, as shown in FIGS. 14 and 15.

Thus, the angle of the conduits 68, 78 will typically be between 5-135 degrees, more preferably from 45-135, and most preferably 85-135 degrees, from the longitudinal axis of the device. The conduits may also be described as extending between 5-135 degrees up and rearward, more preferably from 45-135 degrees up and rearward, and most preferably 85-135 up and rearward from a horizontal plane through the longitudinal axis L.

These conduits 68, 78 (and other conduits, even those at 90 degrees or extending rearward) need not reside entirely in a vertical plane, and, instead, may also (in addition to extending upward and forward or rearward) may also extend to the left or right side, for example, 5-135 degrees. Examples for many mammals may include right and left eye conduits extending 90 degrees upward and 10-30 degrees to the right and left, respectively, depending on the flatness and general contours of the face. Or, for many reptiles, eye conduits may include right and left eye conduits extend 20-40 degrees upward and 60-90 degrees to the right and left, respectively. Examples of nostril conduits for many mammals and reptiles may be that right and left nostril conduits extend 10-90 degrees upward and 10-30 degrees to the right and left, respectively. Conduits may curve, rather than being straight, with the curvature preferably resulting in the conduit curving upward and forward, and probably also to the left or right (given that most creatures have right and left nostrils and right and left eyes).

Figure 16:
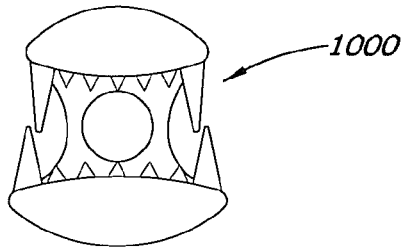
FIG. 16 is a front view of a "jaws-only" embodiment such as that in FIG. 8, but with left and right side teeth extending farther into the mouth space, to the extent that they either touch or overlap, while leaving room between the front upper and front lower teeth to allow passage of the projectile.

FIGS. 3, 4, 5A, 5A, and 6 portray alternative embodiments of the device (100, 200, 300, 400) that have many of the features of the devices 10, 10'. Each of the devices comprises a projectile passageway that represents a creature's mouth, wherein the jaws are spread apart at their distal ends and open at their right and left sides. Teeth, tusks, fangs, and/or a tongue may be included, as long as they do not interfere with the projectile's path. The teeth/tusks/fangs may be of various shapes, but many may be generally conical in shape, with pointed ends, or may be elongated and curved with either a pointed end or a more blunt end, or may be short, blunt protrusions as in human teeth. The teeth, tusks, fangs, or tongue may, for example, extend into the space between the jaws a distance equal to or less than ¼ of the distance between the jaws. This way, up to half of the distance between the jaws would contain teeth or tongue, but half of the space would be empty and free for passage of the projectile. All of the teeth may be short, or just the front upper and front lower teeth may be short, while the right and left teeth may be longer and may even touch or overlap. See, for example, FIG. 16, wherein the front teeth are short, in order to allow passage of the projectile, but the side teeth are long and serve as a partial closure of the right and left side of the mouth.

Figure 5A:
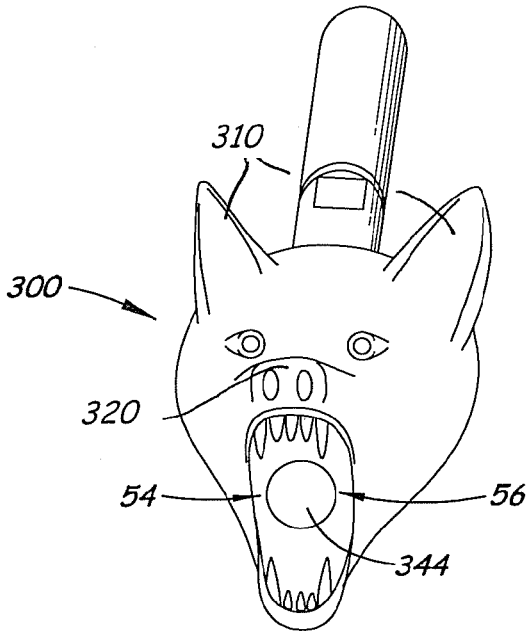
FIG. 5A is a distal end perspective view of a wolf/wild dog embodiment of the invention, where the tubular projectile passageway opening is visible in the mouth.
Figure 5B:
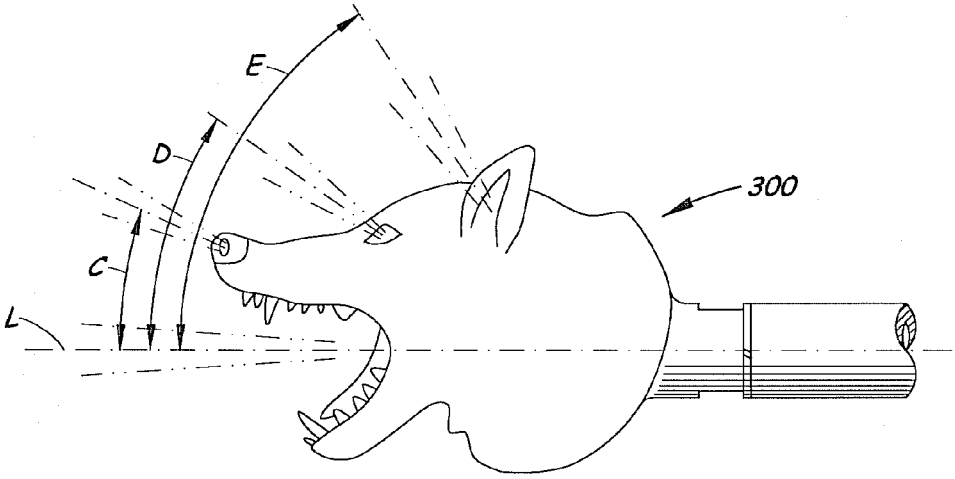
FIG. 5B is a cross-section of the embodiment of FIG. 5A, showing the projectile exiting the mouth, and gas exiting all of the nose, the eyes, and the ears.
Figure 6:
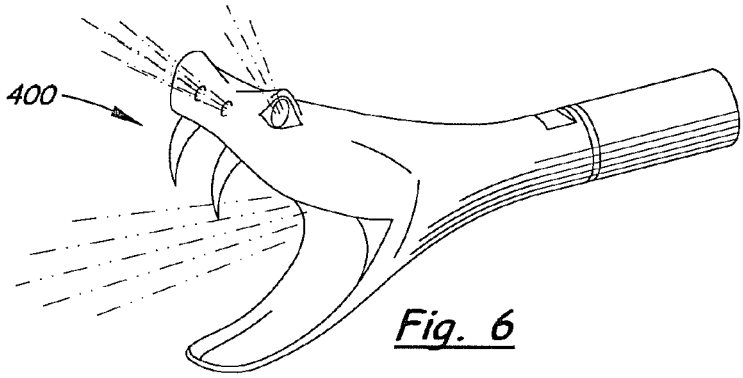
FIG. 6 is a snake embodiment of the invention, with the projectile exiting the open mouth of the snake and the gasses exiting the two nostrils and the two eyes.

FIG. 5A illustrates a round opening 344 of the projectile passageway, but other shapes of opening and passageway may be used, in accordance with desired projectile and ballistics considerations. FIG. 5B illustrates an example of a device that has additional apertures for gas-direction that are nostrils, eyes, and also ears, wherein conduits for these apertures are at acute angles above longitudinal axis L corresponding to angle C, angle D, and angle E, respectively. These conduits will also tend to be slanted/angled to the right and left of the axis L, for right and left nostrils, eyes, ears, respectively, these right and left angles are not called-out except for angles F and G in FIG. 11. These upward and right and left angles will be understood by those of average skill reading and viewing this document.

In the case of creatures with round or almond-shaped eyes, the eye apertures may be those shapes. In the case of creatures that have recessed eye orbits, the outer surface of the device may have ridges or rings at or near the eye apertures that protrude out beyond the surrounding outer surface, typically 2-10 millimeters for a device that is 1-3 inches in diameter. In the case of creatures with ears extending outward from the head to catch sound, the outer surface of the device may have plate-like or flap-like protrusions (or bent, cupped, or rolled protrusions, as may be understood from ear upward protrusions 310 in FIGS. 5A, 5B, and 14) at or near the ear apertures that extend out from the surrounding outer surface of the device, typically 5-20 millimeters for a device that is 1-3 inches in diameter. In the case of creatures with a flattened outer nose end, an outer end of the top jaw may comprise a generally vertical plate with nostril apertures, as may be understood from nose-plate surface 120, 220, 330 in FIGS. 3, 4, and 5A). These outer surface features (especially if large enough and near enough to, or extending over, the aperture openings), may affect the fluid dynamics of the gas flow through the device, and may be taken into account, by one of skill in the art, in the choice of aperture size and location of said outer surface features.

As a creature's nose is typically somewhat centrally-located on a face/head, the nose typically will be an upward and forward, or upward and slightly rearward, gas-directing passage(s). However, as eyes and/or ears of a creature may be forward facing (typical for a human or many mammals) or more side-facing (typical for lizards, snakes, reptiles) the eyes and/or ears may be upward and side-ways-facing (left or right) gas-direction passages. Ears may often be upward and slightly-rearward gas-directing passages (that is, having a rearward direction component), because the ears tend to be more rearward on a human/creature head compared to the other face/head features. As in other rearwardly-extending conduits/surfaces, it is desirable not to have ear conduits extend at greater rearward angles (for example, greater than 135 degrees) so as to limit noise directed at the shooter and to not engender the shooter in other ways.

It may be noticed that some or all of the conduits/surfaces of the additional apertures may branch off of the device's longitudinal bore (projectile passageway including the mouth space), in a distal region of the device rather than in a proximal region of the device. This distal region of the device may be in the space between the jaws and/or otherwise in the mouth space. For example, FIG. 15 illustrates an embodiment wherein both the nose hole and eye conduits have lower ends branching off from, and in fluid communication with, the mouth. The mouth may have a different, especially a larger, diameter compared to the proximal region of the projectile passageway, so fluid dynamics will be especially important in selecting conduit size and angle in these distal conduit embodiments.

Device 300 illustrates gas flow forward from the creature's mouth, and forward and upward out of all of the creature's nostrils, eyes, and ears. Device 400 illustrates flow forward from the mouth, and forward and upward flow from all of the nostrils and eyes.

Figure 7:
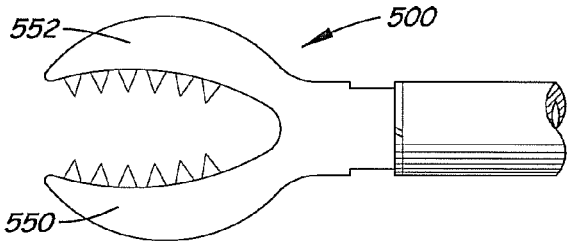
FIG. 7 is a "jaws only" embodiment of the invention, wherein open jaws are provided, but little else of the creature is included, emphasizing that an embodiment may be only a portion of a face/head. Typically, the embodiment will be at least the jaws, or at least a front portion of a face/head. Alternatively, more of a creature's body, or the entire creature's body, may be used as the main body of the device.
Figure 8:
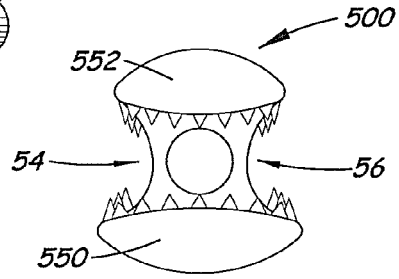
FIG. 8 is a front view of an embodiment that includes a lower jaw that is significantly wider that the upper jaw, which may provide muzzle braking functionality by the force of gases on the increased lower jaw surface area, rather than by providing eyes, ear or nose openings for gas-direction.

It will be understood that gas will also exit the device through the projectile passageway, and this may provide some gas direction, and muzzle braking, depending on the shape and orientation of the surfaces against which the gas will impact on its path. For example, the simpler device 500 shown in FIGS. 7 and 8 illustrate a "jaws only" embodiment that is only a portion of a face/head. This device 500 essentially comprises a lower jaw 550 and an upper jaw 552, without the other face and head portions normally associated with a creature, for example, without nostrils, forehead, eyes and ears. The lower jaw 550 is wider from left to right, as shown in FIG. 8, and it has a greater upper surface area compared to the lower surface area of the narrower upper jaw 552. This may provide a greater total force of gas against the lower jaw, hence, tending to lower the muzzle. "Eyes only" or other partial-face/partial-head embodiments (rather than the entire face or head) may be included in the invention.

FIGS. 9, 10, 12, and 13 illustrate two embodiments of the invented device 600, 700 that are in the likeness of a human skull. These devices 600, 700 are shown with a threaded connection at or near the rear of the skull, but it will understood that other connections may be used. For example, FIG. 11 portrays a pinned connection wherein a rearwardly-extending cylinder/tube 810 slides over the muzzle end 812, so that the front sight 830 of the firearm slides into a slit 832 in the cylinder/tube 810. A pin 834 slides through/into, and is captured by, notches/holes in the cylinder/tube 810, behind the sight 830. This way, the device 800 is retained from sliding off the muzzle, and the sight 830 being received in the slit 832 will prevent rotation of the device 800 relative to the nuzzle. Additionally, or optionally, a set screw 836, which extends from the tube/810 to abut against the muzzle, may be provided to further secure, and prevent rotation of, the device relative to the weapon.

Figure 9:
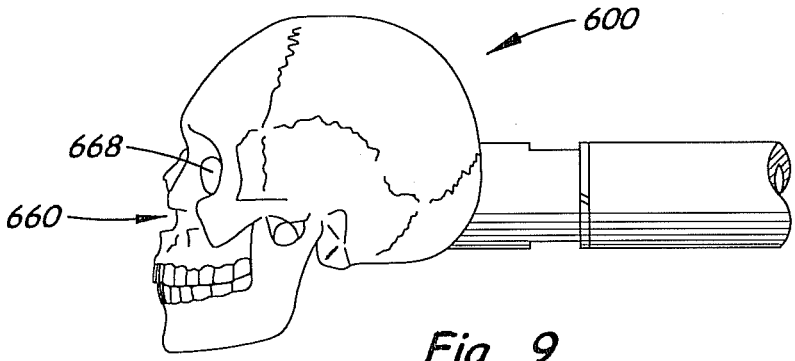
FIGS. 9 and 10 are side views of human skull embodiments.
Figure 11:
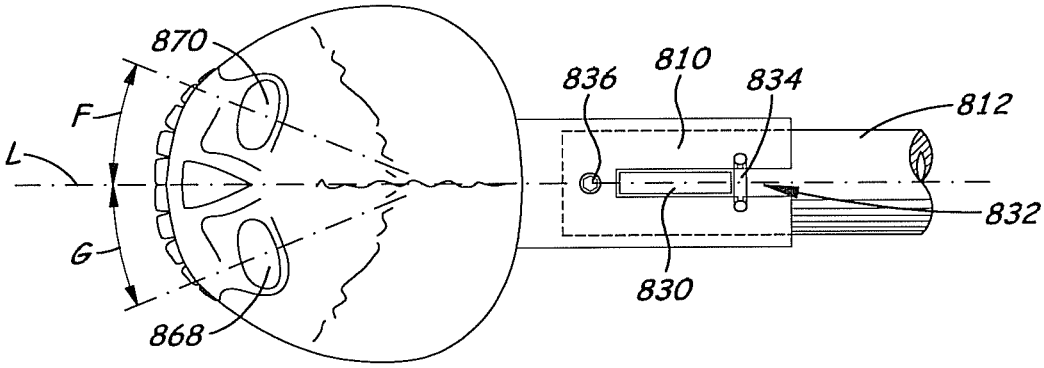
FIG. 11 is a top view of a skull embodiment featuring an alternative connection system.
Figure 12:
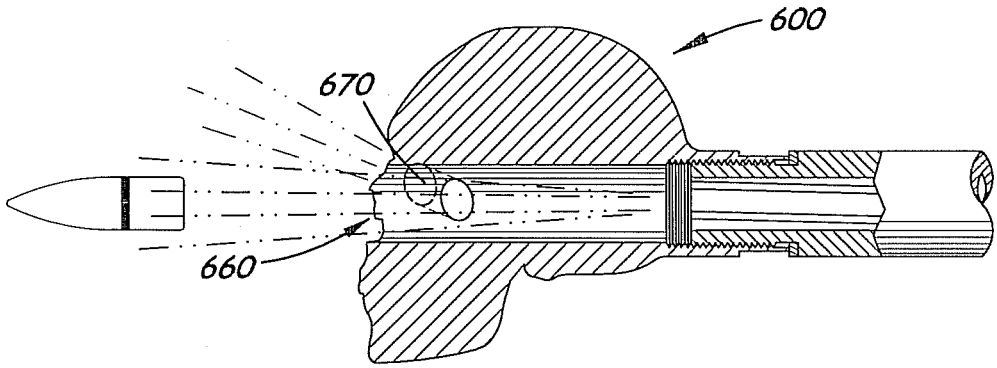
FIGS. 12 and 13 are cross-sectional views of FIGS. 9 and 10, respectively. The skull in FIGS. 9 and 12 allows the projectile to exit the nose of the skull and the gasses to exit the eye holes, and the skull in FIGS. 10 and 13 allows the projectile to exit the open mouth and the gasses to exit the eye holes and nose holes.

FIGS. 9 and 12 portray a version wherein the projectile passageway opens through the nose hole/conduit 660 of the skull, and wherein gasses exit both through the nose hole/conduit 660 and the eye sockets/conduits (left eye 668 in FIG. 9, right eye 670 in FIG. 12, and see 868, 870 in FIG. 11). It will be understood that the nose hole 660 will need to be sized to allow passage of the projectile. The eye socket conduits in this embodiment have longitudinal axes at an acute angle(s) relative to the longitudinal axis L of the device and projectile passageway. The two eye socket conduits may be at the same or generally the same angle to axis L, which would be in keeping with the natural appearance of a human skull, or may be at different angles.

Figure 10:
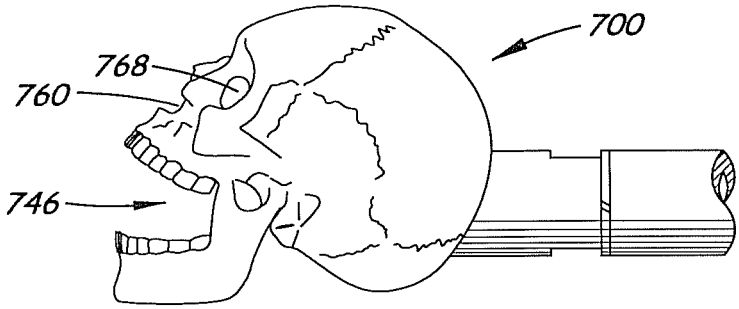
Figure 13:
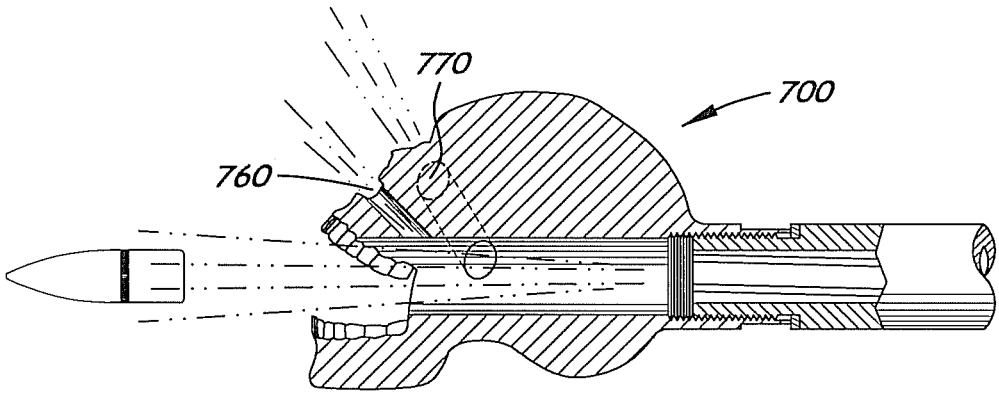

FIGS. 10 and 13 portray a version wherein the skull is tilted rearward, as if in a laughing position, and the projectile passageway opens through the mouth 746 of the skull, and wherein gasses exit both through the mouth 746, the nose hole 760, and the eye sockets (left eye 768 in FIG. 10, right eye 770 in FIG. 13, and see 868, 870 in FIG. 11). It will be understood that the mouth 746 will need to be sized to allow passage of the projectile. The nose and eye socket conduits in this embodiment have longitudinal axes at acute angle(s) relative to the longitudinal axis L of the device and projectile passageway. The two eye socket conduits may be at the same or generally the same angle to axis L, which would be in keeping with the natural appearance of a human skull, or may be at different angles. The eye socket conduits tend to be at greater angles to L than the nose conduit angle, because the nose is lower on the skull face than the eyes.

Some embodiments of the invention may be described as an accessory for connection to a distal end of a muzzle of a weapon, the accessory comprising: a main body having a distal end, a proximal end for connection to the muzzle, a longitudinal projectile passageway extending through the main body from the proximal end to the distal end so that the passageway is an aperture for allowing a weapon projectile to exit from muzzle through the main body; and at least one additional aperture in the main body comprising a conduit extending from, and in fluid communication with, the passageway to an outer surface of the main body, each conduit extending at an angle to said passageway in the range of 5-135 degrees so that each conduit extends upward and forward, straight upward, or upward and rearward, from said passageway; wherein a distal surface of said main body is shaped as a front of a face or head of a creature and said at least one additional aperture is selected from the group consisting of: an eye, a nostril, a nose, and an ear of said creature, and wherein said at least one additional aperture directs gasses from discharge of said weapon upward and forward relative to the muzzle. The creature may be selected from the group consisting of: a human, an animal, a mythical creature, a portion of a human head, a portion of an animal head, and a portion of a mythical creature head. The at least one additional aperture may comprise at least one nostril aperture, and two eye apertures. The at least one additional aperture may comprise at least one nostril aperture, two eye apertures, and two ear apertures. The at least one nostril aperture and eye apertures may comprise round openings or oval openings at said outer surface, for example. In many embodiments, the mouth, nostril, eye, and ear apertures are the only gas-exit apertures in the main body and there are no conventional muzzle brake slits along a cylindrical tube as in conventional muzzle brakes. In many embodiments, there are no muzzle brake slits or slots unless they are surrounded by outer surface curvature, recesses, protrusions, or marking that have the appearance of flesh, fur, feathers, scales, or bone around a creatures face of hear features.

Embodiments of the invention may instead be described as a muzzle brake accessory for connection to a distal end of a muzzle of a weapon, the accessory comprising: a main body having a proximal end for connection to the muzzle, an opposing distal end, a longitudinal projectile passageway extending through the main body from the proximal end to the distal end so that the passageway is an aperture for allowing a weapon projectile to exit the muzzle through the main body; wherein said distal end comprises a lower jaw plate and an upper jaw plate projecting forward from a distal opening of said projectile passageway, said lower and upper jaw plates being connected to the main body at their proximal ends and vertically separated from each other at their distal ends to form a mouth aperture through which a projectile passes forward out of the accessory between said jaw plates, the accessory distal end being open at right and left sides so that right and left edges of said jaw plates are not connected to each other. Tooth protrusions may extend down from the upper jaw plate into the space between said upper and lower jaw a distance equal to ¼ or less of the distance between the upper and lower jaws, and tooth protrusions may extend upward from the lower jaw plate into the space between said upper and lower jaws a distance equal to ¼ or less of the distance between the upper and lower jaw. Because they will not interfere with passage of the projectile, left side and right side teeth may extend farther than ¼ of said distance between the upper and lower jaws, and, instead, may touch, overlap, or extend all the way to or past the opposing jaw. A preferred feature is that the main body of the device has additional apertures extending from said passageway to an outer upper surface of the main body for directing gasses from discharge of the weapon upward and forward relative to the muzzle so that the muzzle is forced downward. The main body may be a head shape and said additional apertures may be selected from a group consisting of a nose aperture, a nostril aperture, an eye aperture, an ear aperture, two nostril apertures, two eye apertures, and two ear apertures. Each additional aperture may comprise an elongated conduit open on an inner end to said passageway and open on an opposite, outer end to an outer, upper surface of the main body, said elongated conduit of each of said additional aperture extending upward, upward and forward, or upward and rearward, so that the conduit may be at an angle of 5-135, for example, relative to, and above, the longitudinal axis of said passageway. The conduit may also extend to the left or the right. Said angle, and the direction and location of each aperture, is typically selected to cause gasses exiting through said conduits to force said main body and said muzzle downward (anti-muzzle-climb force), to force the muzzle forward (anti-recoil force), and also be form a realistic appearance of the creature being formed by the main body. Preferably, the mouth, nose/nostril, eye and ear apertures are the only gas-exit apertures in the main body and ear apertures are the only gas-exit apertures in the main body and there are no conventional muzzle brake slits along a cylindrical tube as in conventional muzzle brakes. The lower jaw of a set of jaws forming the mouth of the device, may be wider from right to left than said upper jaw, so that gasses exiting between the lower jaw and upper jaw will contact more lower jaw surface area than upper jaw surface area to force the main body and muzzle downward.

Although this invention has been described above with reference to particular means, materials and embodiments, it is to be understood that the invention is not limited to these disclosed particulars, but extends instead to all equivalents within the scope of the following claims.

The invention claimed is:

1. An accessory for connection to a distal end of a muzzle of a weapon, the accessory comprising:

a main body having a distal end, a proximal end for connection to the muzzle, a longitudinal projectile passageway extending through the main body from the proximal end to the distal end so that the passageway is an aperture for allowing a weapon projectile to exit from muzzle through the main body; and at least one additional aperture in the main body comprising a conduit extending from, and in fluid communication with, the passageway to an outer surface of the main body, each conduit extending generally upward from said passageway;

wherein a distal surface of said main body is shaped as a front of a face or head of a creature and said at least one additional aperture is selected from the group consisting of: an eye, a nostril, a nose, and an ear of said creature, and wherein said at least one additional aperture directs gasses from discharge of said weapon upward and forward relative to the muzzle;

wherein said at least one additional aperture comprises at least one nostril aperture, two eye apertures, and two ear apertures and wherein a plate protrusion extends generally upward from near each of said ear apertures.

2. An accessory as in claim 1, wherein said creature is selected from the group consisting of: a human, an animal, a mythical creature, a portion of a human head, a portion of an animal head, and a portion of a mythical creature head.

3. An accessory as in claim 1, wherein each conduit extends generally upward from said passageway at an angle to said longitudinal axis, said angle being in the range of 5-135 degrees.

4. An accessory for connection to a distal end of a muzzle of a weapon, the accessory comprising:

a main body having a distal end, a proximal end for connection to the muzzle, a longitudinal projectile passageway extending through the main body from the proximal end to the distal end so that the passageway is an aperture for allowing a weapon projectile to exit from muzzle through the main body; and at least one additional aperture in the main body comprising a conduit extending from, and in fluid communication with, the passageway to an outer surface of the main body, each conduit extending generally upward from said passageway;

wherein a distal surface of said main body is shaped as a front of a face or head of a creature and said at least one additional aperture is selected from the group consisting of: an eye, a nostril, a nose, and an ear of said creature, and wherein said at least one additional aperture directs gasses from discharge of said weapon upward and forward relative to the muzzle; wherein a distal end of said projectile passageway is larger in diameter than a proximal end of said projectile passageway and is defined by upper and lower generally horizontal plates being spaced apart by a mouth space that has an open right and left side, wherein a plurality of tooth protrusions extend generally vertically from said front edges and right and left edges of the upper and lower generally horizontal plates.

5. An accessory as in claim 4, wherein said at least one additional aperture comprises at least one nostril aperture that extends through a generally vertical plate at a front-most edge of said upper generally horizontal plate.

6. An accessory for connection to a distal end of a muzzle of a weapon, the accessory comprising:

a main body having a distal end, a proximal end for connection to the muzzle, a longitudinal projectile passageway extending through the main body from the proximal end to the distal end so that the passageway is an aperture for allowing a weapon projectile to exit from muzzle through the main body; and at least one additional aperture in the main body comprising a conduit extending from, and in fluid communication with, the passageway to an outer surface of the main body, each conduit extending generally upward from said passageway;

wherein a distal surface of said main body is shaped as a front of a face or head of a creature and said at least one additional aperture is selected from the group consisting of: an eye, a nostril, a nose, and an ear of said creature, and wherein said at least one additional aperture directs gasses from discharge of said weapon upward and forward relative to the muzzle;

wherein the mouth, nostril, nose, eye, and ear apertures are the only gas-exit apertures in the main body.

7. A muzzle brake accessory for connection to a distal end of a muzzle of a weapon, the accessory comprising:

a main body having a proximal end for connection to the muzzle, an opposing distal end, a longitudinal projectile passageway extending through the main body from the proximal end to the distal end so that the passageway is an aperture for allowing a weapon projectile to exit the muzzle through the main body;

wherein said distal end comprises a lower jaw plate and an upper jaw plate projecting forward from a distal opening of said projectile passageway, said lower and upper jaw plates being connected to the main body at their proximal ends and vertically separated from each other at their distal ends to form a mouth aperture through which a projectile passes forward out of the accessory between said jaw dates, the accessory distal end being open at right and left sides so that right and left edges of said jaw plates are not connected to each other;

wherein tooth protrusions extend down from the upper jaw plate into the space between said upper and lower jaw a distance equal to ¼ or less of the distance between the upper and lower jaws, and tooth protrusions extend upward from the lower jaw plate into the space between said upper and lower jaws a distance equal to ¼ or less of the distance between the upper and lower jaw.

8. An accessory as in claim 7, wherein the main body has additional apertures extending from said passageway to an outer upper surface of the main body for directing gasses from discharge of the weapon generally upward relative to the muzzle so that the muzzle is forced downward.

9. An accessory as in claim 8 wherein the main body is a head shape and said additional apertures are selected from a group consisting of a nose aperture, a nostril aperture, an eye aperture, an ear aperture, two nostril apertures, two eye apertures, and two ear apertures.

10. An accessory as in claim 8 wherein each additional aperture comprises an elongated conduit open on an inner end to said passageway and open on an opposite, outer end to an outer, upper surface of the main body, said elongated conduit of each of said additional aperture extending distally and upward at an angle of 5-135 degrees relative to, and above, the longitudinal axis of a distal portion of said passageway.

11. An accessory as in claim 10, wherein said angle is selected to cause gasses exiting through said conduits to force said main body and said muzzle downward.

12. A muzzle brake accessory for connection to a distal end of a muzzle of a weapon, the accessory comprising:

a main body having a proximal end for connection to the muzzle, an opposing distal end, a longitudinal projectile passageway extending through the main body from the proximal end to the distal end so that the passageway is an aperture for allowing a weapon projectile to exit the muzzle through the main body;

wherein said distal end comprises a lower jaw plate and an upper jaw plate projecting forward from a distal opening of said projectile passageway said lower and upper jaw plates being connected to the main body at their proximal ends and vertically separated from each other at their distal ends to form a mouth aperture through which a projectile passes forward out of the accessory between said jaw plates, the accessory distal end being open at right and left sides so that right and left edges of said jaw plates are not connected to each other;

wherein upper tooth protrusions extend down from right and left edges of the upper jaw plate and lower tooth protrusions extend up from right and left edges of the upper jaw plate, and said upper tooth protrusions and said lower tooth protrusions touch or overlap to partially close right and left sides of said mouth aperture.

13. A muzzle brake accessory for connection to a distal end of a muzzle of a weapon, the accessory comprising:

a main body having a proximal end for connection to the muzzle, an opposing distal end, a longitudinal projectile passageway extending through the main body from the proximal end to the distal end so that the passageway is an aperture for allowing a weapon projectile to exit the muzzle through the main body;

wherein said distal end comprises a lower jaw plate and an upper jaw plate projecting forward from a distal opening of said projectile passageway, said lower and upper jaw plates being connected to the main body at their proximal ends and vertically separated from each other at their distal ends to form a mouth aperture through which a projectile passes forward out of the accessory between said jaw plates, the accessory distal end being open at right and left sides so that right and left edges of said jaw plates are not connected to each other;

wherein said lower jaw is wider from right to left than said upper jaw, so that gasses exiting between the lower jaw and upper jaw will contact more lower jaw surface area than upper jaw surface area to force the main body and muzzle downward.

14. A muzzle brake accessory for connection to a distal end of a muzzle of a weapon, the accessory comprising:

a main body having a proximal end for connection to the muzzle, an opposing distal end, a longitudinal projectile passageway extending through the main body from the proximal end to the distal end so that the passageway is an aperture for allowing a weapon projectile to exit the muzzle through the main body;

wherein said distal end comprises a lower jaw plate and an upper jaw plate projecting forward from a distal opening of said projectile passageway, said lower and upper jaw plates being connected to the main body at their proximal ends and vertically separated from each other at their distal ends to form a mouth aperture through which a projectile passes forward out of the accessory between said jaw plates, the accessory distal end being open at right and left sides so that right and left edges of said jaw plates are not connected to each other;

wherein the mouth, nose, eye and ear apertures are the only gas-exit apertures in the main body.

* * * * *